US011514849B2

(12) United States Patent
Pyun et al.

(10) Patent No.: US 11,514,849 B2
(45) Date of Patent: Nov. 29, 2022

(54) DISPLAY DEVICE AND DRIVING METHOD THEREOF

(71) Applicant: Samsung Display Co., Ltd., Yongin-Si (KR)

(72) Inventors: Ki Hyun Pyun, Yongin-si (KR); Myoung Seop Song, Yongin-si (KR); Myung Ho Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/665,990

(22) Filed: Feb. 7, 2022

(65) Prior Publication Data

US 2022/0157232 A1 May 19, 2022

Related U.S. Application Data

(63) Continuation of application No. 16/842,444, filed on Apr. 7, 2020, now Pat. No. 11,244,600.

(30) Foreign Application Priority Data

Jul. 9, 2019 (KR) ..... 10-2019-0082651

(51) Int. Cl.
*G09G 3/30* (2006.01)
*G09G 3/32* (2016.01)

(52) U.S. Cl.
CPC ..... *G09G 3/32* (2013.01); *G09G 2310/027* (2013.01); *G09G 2310/08* (2013.01)

(58) Field of Classification Search
CPC . G09G 3/32; G09G 2310/027; G09G 2310/08
See application file for complete search history.

(56) References Cited

U.S. PATENT DOCUMENTS 8,600,049 B2 12/2013 Gueron et al.
10,303,286 B2 5/2019 Son et al.
(Continued)

FOREIGN PATENT DOCUMENTS

JP 2010-256783 A 11/2010
KR 10-1352107 B1 1/2014
(Continued)

OTHER PUBLICATIONS

Extended European Search Report, Application No. 20182951.2 dated Sep. 23, 2020, 10 pages.

*Primary Examiner* — Sanghyuk Park
(74) *Attorney, Agent, or Firm* — Innovation Counsel LLP

(57) ABSTRACT

A display device and a driving method thereof are disclosed, and the display device includes a first pixel connected to a first data line, a first scan line, and a first power source line, emitting light in a first period, and not emitting light in a second period following the first period; a second pixel connected to a second data line, the first scan line, and the first power source line, not emitting light in the first period, and emitting light in the second period; a current sensor sensing a current flowing through the first power source line in the first period to provide a first sensing current value, and sensing the current flowing through the first power source line in the second period to provide a second sensing current value; and a memory storing a first block target current value corresponding to the first sensing current value and a second block target current value corresponding to the second sensing current value.

20 Claims, 9 Drawing Sheets

(56) References Cited

U.S. PATENT DOCUMENTS

| | | | | |
|---|---|---|---|---|
| 2005/0057580 | A1* | 3/2005 | Yamano | G09G 3/325 345/690 |
| 2010/0103083 | A1 | 4/2010 | Shin et al. | |
| 2013/0027383 | A1* | 1/2013 | Odawara | G09G 3/3233 345/212 |
| 2015/0379967 | A1 | 12/2015 | Kim | |
| 2018/0020525 | A1 | 1/2018 | Moon et al. | |
| 2018/0033374 | A1 | 2/2018 | Jeong et al. | |
| 2019/0005889 | A1* | 1/2019 | Kwon | G09G 3/3233 |
| 2019/0340965 | A1 | 11/2019 | Chang et al. | |

FOREIGN PATENT DOCUMENTS

| | | | |
|---|---|---|---|
| KR | 10-2018-0036298 | A | 4/2018 |
| KR | 10-2018-0078995 | A | 7/2018 |

* cited by examiner

DISPLAY DEVICE AND DRIVING METHOD THEREOF

CROSS-REFERENCE TO RELATED APPLICATION

The application a continuation application of U.S. patent application Ser. No. 16/842,444 filed on Apr. 7, 2020, which claims priority to and the benefit of Korean Patent Application No. 10-2019-0082651, filed Jul. 9, 2019, which is hereby incorporated by reference for all purposes as if fully set forth herein.

BACKGROUND

Field

Exemplary embodiments relate to a display device and a driving method thereof.

Discussion

With the development of information technology, the importance of display devices, which are a connection medium between users and information, has been emphasized. In response to this, the use of display devices such as a liquid crystal display device, an organic light emitting display device, and a plasma display device has been increasing.

The display device may include pixels, and image frames displayed by the pixels may have different load values. That is, an image frame corresponding to a bright image may have a large load value, and an image frame corresponding to a dark image may have a small load value.

As the load value increases, the amount of current required by the pixels may increase. If the current supplied to the pixels is insufficient, luminance of the image frame displayed by the pixels may be lower than a target luminance.

As the load value decreases, the amount of current required by the pixels may decrease. If the current supplied to the pixels is excessive, the luminance of the image frame displayed by the pixels may be higher than the target luminance, and power may be unnecessarily consumed.

Therefore, it is important to supply an appropriate current to the pixels in response to the load value of the image frame. However, due to a process variation of the pixels, light emission efficiency of the pixels may be different for each display area. The light emission efficiency of a pixel may mean light emission luminance of the pixel compared to a current supplied to the pixel. Therefore, it is difficult to select an appropriate current to be supplied to the pixels corresponding to the load value of the image frame.

SUMMARY

An object of the present inventive concept is to provide a display device and a driving method capable of supplying an appropriate current to pixels having different light emission efficiencies in response to a load value of an image frame.

According to some exemplary embodiments, a display device may include a first pixel connected to a first data line, a first scan line, and a first power source line, emitting light in a first period, and not emitting light in a second period following the first period; a second pixel connected to a second data line, the first scan line, and the first power source line, not emitting light in the first period, and emitting light in the second period; a current sensor sensing a current flowing through the first power source line in the first period to generate a first sensing current value, and sensing the current flowing through the first power source line in the second period to generate a second sensing current value; and a memory storing a first block target current value corresponding to the first sensing current value and a second block target current value corresponding to the second sensing current value.

The display device may further include a block target current value generator generating a representative value of the first sensing current values provided a plurality of times in the first period as the first block target current value, and generating a representative value of the second sensing current values provided a plurality of times in the second period as the second block target current value.

The display device may further include a target current profile generator generating a target current profile corresponding to a histogram including the first block target current value and the second block target current value.

The display device may further include a unit target current value generator determining target current waveforms based on the target current profile, and generating a unit target current value that is an instantaneous value of the target current waveforms.

The display device may further include a scale factor generator generating a target current value using the unit target current value and a frame load value corresponding to the unit target current value, and generating a scale factor according to a difference between a sensing current value provided by the current sensor and the target current value.

The display device may further include a timing controller scaling a first grayscale value for the first pixel and a second grayscale value for the second pixel using the scale factor.

The display device may further include a data driver applying a first data voltage corresponding to a scaled first grayscale value to the first data line, and applying a second data voltage corresponding to a scaled second grayscale value to the second data line.

According to some exemplary embodiments, a display device may include a first pixel connected to a first data line, a first scan line, and a first power source line; a second pixel connected to a second data line, the first scan line, and the first power source line; a current sensor sensing a current flowing through the first power source line to generate a sensing current value; a timing controller scaling a first grayscale value for the first pixel and a second grayscale value for the second pixel based on grayscale values of a frame and the sensing current value; and a data driver applying a first data voltage corresponding to a scaled first grayscale value to the first data line, and applying a second data voltage corresponding to a scaled second grayscale value to the second data line, wherein the sensing current value, the first data voltage, and the second data voltage may be changed although the grayscale values remain the same in successive frames.

The first pixel may emit light in a first period, and emit no light in a second period after the first period. The second pixel may emit no light in the first period, and emit light in the second period. The current sensor may sense a current flowing through the first power source line in the first period to generate a first sensing current value, and sense the current flowing through the first power source line in the second period to generate a second sensing current value.

The display device may further include a block target current value generator generating a representative value of the first sensing current values provided a plurality of times in the first period as a first block target current value, and generating a representative value of the second sensing current values provided a plurality of times in the second period as a second block target current value.

The display device may further include a memory storing the first block target current value and the second block target current value.

The display device may further include a target current profile generator generating a target current profile corresponding to a histogram including the first block target current value and the second block target current value.

The display device may further include a unit target current value generator determining target current waveforms based on the target current profile provided by the target current profile generator, and generating a unit target current value that is an instantaneous value of the target current waveforms.

The display device may further include a scale factor generator generating a target current value using the unit target current value and a frame load value corresponding to the unit target current value, and generating a scale factor according to a difference between a sensing current value provided by the current sensor and the target current value. The frame load value may correspond to the grayscale values of the frame.

According to some exemplary embodiments, a driving method of a display device may include: emitting light through a first pixel connected to a first data line, a first scan line, and a first power source line and not emitting light through a second pixel connected to a second data line, the first scan line, and the first power source line in a first period; sensing, by a current sensor, a current flowing through the first power source line to provide a first sensing current value; storing, by a memory, a first block target current value corresponding to the first sensing current value; emitting light through the second pixel and not emitting light through the first pixel in a second period; sensing, by the current sensor, the current flowing through the first power source line to generate a second sensing current value in the second period; and storing, by the memory, a second block target current value corresponding to the second sensing current value.

The driving method may further include generating a representative value of the first sensing current values provided a plurality of times in the first period as the first block target current value; and generating a representative value of the second sensing current values provided a plurality of times in the second period as the second block target current value.

The driving method may further include generating a target current profile corresponding to a histogram including the first block target current value and the second block target current value.

The driving method may further include determining target current waveforms based on the target current profile, and generating a unit target current value that is an instantaneous value of the target current waveforms.

The driving method may further include generating a target current value using the unit target current value and a frame load value corresponding to the unit target current value; and generating a scale factor according to a difference between a sensing current value provided by the current sensor and the target current value.

The driving method may further include scaling a first grayscale value for the first pixel and a second grayscale value for the second pixel using the scale factor; and applying a first data voltage corresponding to the scaled first grayscale value to the first data line, and applying a second data voltage corresponding to the scaled second grayscale value to the second data line.

According to some exemplary embodiments, a display device may include a plurality of blocks including at least a first block which includes a plurality of first pixels and a second block which includes a plurality of second pixels, the plurality of blocks being connected to a first power source line; a current sensor connected to the first power source line, the current sensor sensing a current flowing through the first power source line during a first period when the plurality of first pixels in the first block emit light and the plurality of second pixels in the second block do not emit light, and a current flowing through the first power source line during a second period when the plurality of second pixels in the second block emit light and the plurality of first pixels in the first block do not emit light; a scale factor provider connected to the current sensor and a timing controller, the scale factor including a memory storing a first block target current value which correspond to the current flowing through the first power source line during the first period and a second block target current value which correspond to the current flowing through the first power source line during the second period.

The current sensor may sense the current flowing through the first power source line at least two times during the first period and the second period, respectively, to generate a plurality of first sensing current values and a plurality of second sensing current values. The scale factor provider may further include a block target current value generator connected to the current sensor and generating a representative value of the plurality of the first sensing current values as the first block target current value, and generating a representative value of the plurality of the second sensing current values as the second block target current value.

The scale factor provider may further include a target current profile generator connected to the memory and generating a target current profile corresponding to a histogram including the first block target current value and the second block target current value.

The scale factor provider may further include a unit target current value generator connected to the target current profile generator, determining target current waveforms based on the target current profile, and generating a unit target current value that is an instantaneous value of the target current waveforms.

The scale factor provider may further include a scale factor generator connected to the unit target current value generator and generating a target current value using the unit target current value and a frame load value corresponding to the unit target current value, and generating a scale factor according to a difference between a sensing current value provided by the current sensor and the unit target current value.

The timing controller may scale a first grayscale value for the plurality of first pixels and a second grayscale value for the plurality of second pixels using the scale factor.

scale factor provider may further include a data driver connected to the plurality of blocks and applying first data voltages corresponding to scaled first grayscale values to the plurality of first pixels and applying second data voltages corresponding to scaled second grayscale values to the plurality of second pixels.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
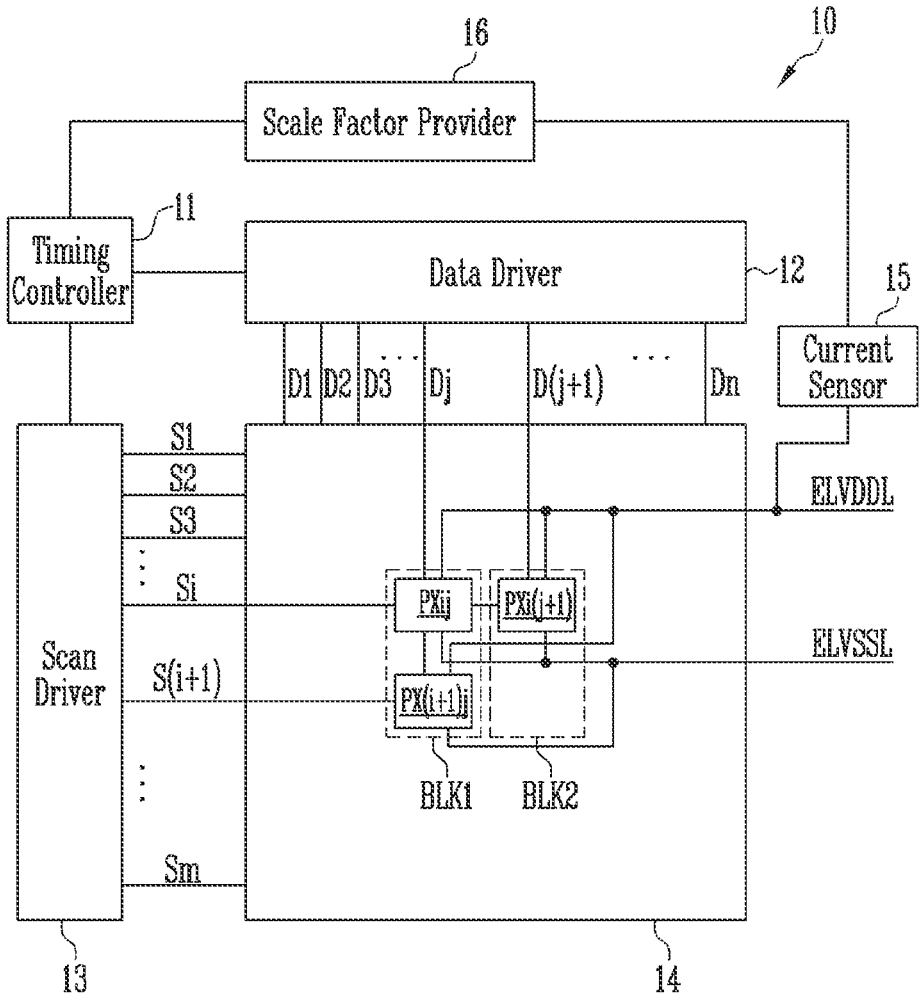
FIG. 1 is a block diagram illustrating a display device according to an embodiment of the present inventive concept.

Hereinafter, preferred embodiments of the inventive concept will be described in detail with reference to the accompanying drawings. The following embodiments are provided so that those skilled in the art will be able to fully understand and carried out the inventive concept. The embodiments can be modified in various ways. The scope of the inventive concept is not limited to the embodiments described below.

In order to clearly describe the present inventive concept, parts irrelevant to the description are omitted. Like reference numerals designate like elements throughout the specification. Therefore, the aforementioned reference numerals may be used in other drawings.

In addition, the size and thickness of each component shown in the drawings are arbitrarily shown for convenience of description. The present inventive concept is not necessarily limited to what is shown. In the drawings, the thicknesses may be exaggerated for clarity in expressing layers and regions.

FIG. 1 is a block diagram illustrating a display device according to an embodiment of the present inventive concept.

Referring to FIG. 1, a display device 10 according to an embodiment of the present inventive concept may include a timing controller 11, a data driver 12, a scan driver 13, a pixel unit 14, a current sensor 15, and a scale factor provider 16.

The timing controller 11 may receive grayscale values for each frame and control signals from an external processor. The timing controller 11 may render the grayscale values to correspond to specifications of the display device 10. For example, the external processor may provide a red grayscale value, a green grayscale value, and a blue grayscale value for each unit dot. However, for example, when the pixel unit 14 has a pentile structure, because adjacent unit dots share pixels, the pixels may not correspond one-to-one to grayscale values. In this case, it may be necessary to render the grayscale values. When the pixels correspond one-to-one to the grayscale values, it may be unnecessary to render the grayscale values. The grayscale values which is rendered or not rendered may be provided to the data driver 12. At this time, the grayscale values provided to the data driver 12 may be in a scaled state by the scale factor provided by the scale factor provider 16. In addition, the timing controller 11 may provide control signals suitable for the respective specifications to the data driver 12, the scan driver 13, and the like for displaying the frame.

The data driver 12 may generate data voltages to be provided to data lines D1, D2, D3, . . . , Dj, D(j+1), . . . , and Dn using the gray scale values and the control signals. For example, the data driver 12 may sample the grayscale values using a clock signal and apply the data voltages corresponding to the grayscale values to the data lines D1 to Dn in pixel row units (for example, a set of pixels connected to the same scan line), wherein n and j may be integers greater than zero.

The scan driver 13 may receive the clock signal, a scan start signal, and the like from the timing controller 11, and generate scan signals to be provided to scan lines S1, S2, S3, . . . , Si, S(i+1), . . . , and Sm, wherein m and i may be integers greater than zero.

The scan driver 13 may sequentially supply the scan signals having a pulse of a turn-on level to the scan lines S1 to Sm. The scan driver 13 may include scan stages which include shift registers. The scan driver 13 may generate the scan signals by sequentially transmitting the scan start signal in the form of a pulse having a turn-on level to the next scan stage under the control of the clock signal.

The pixel unit 14 may include pixels PXij, PXi(j+1) and PX(i+1)j. Each of the pixels PXij, PXi(j+1), and PX(i+1)j may be connected to corresponding data lines and corresponding scan lines. In the pixel PXij, a scan transistor may be connected to an i-th scan line Si and a j-th data line Dj. In the pixel PXi(j+1), a scan transistor may be connected to the i-th scan line Si and a (j+1)th data line D(j+1). In the pixel PX(i+1)j, a scan transistor may be connected to an (i+1)th scan line S(i+1) and the j-th data line Dj. The pixels PXij, PXi(j+1) and PX(i+1)j may be commonly connected to a first power source line ELVDDL. At this time, the pixels PXij, PXi(j+1) and PX(i+1)j may be commonly connected to a second power source line ELVSSL. In another embodiment, the pixels PXij, PXi(j+1), and PX(i+1)j may be connected to different second power source lines. That is, different second power source voltages may be applied to the pixels PXij, PXi(j+1) and PX(i+1)j.

According to another embodiment, the pixels PXij, PXi(j+1) and PX(i+1)j may be commonly connected to the second power source line ELVSSL, and the pixels PXij, PXi(j+1) and PX(i+1)j may be connected to different first power source lines. In this case, unlike the embodiment of FIG. 1, the current sensor 15 may be connected to the second power source line ELVSSL to sense current flowing through the second power source line ELVSSL.

The pixel unit 14 may include a plurality of blocks BLK1 and BLK2. Each of the blocks BLK1 and BLK2 may include at least one pixel. For example, the first block BLK1 may include pixels PXij and PX(i+1)j, and the second block BLK2 may include pixels PXi(j+1).

The current sensor 15 may be connected to the first power source line ELVDDL. In this case, the current sensor 15 may sense a current flowing through the first power source line ELVDDL to provide a sensing current value to the scale factor provider 16. As described above, in another embodiment, the current sensor 15 may be connected to the second power source line ELVSSL connected to the pixels PXij, PXi(j+1) and PX(i+1)j in common. At this time, the current sensor 15 may sense a current flowing through the second power source line ELVSSL to provide the sensing current value to the scale factor provider 16. Because the current sensor 15 is connected to a common power source line of all the pixels of the pixel unit 14, even if only one current sensor is provided, embodiments of the present inventive concept can be implemented.

The display device 10 may sequentially emit light through the blocks BLK1 and BLK2, and the current sensor 15 may provide sensing current values to the scale factor provider 16 at each time point. In this case, block target current values corresponding to the sensing current values may be sequentially stored in a memory. For example, the pixels PXij and PX(i+1)j of the first block BLK1 may emit light in a first period and may not emit light in a second period following the first period. The pixel PXi(j+1) of the second block BLK2 may not emit light in the first period and emit light in the second period. The current sensor 15 may sense the current flowing through the first power source line ELVDDL in the first period to provide a first sensing current value to the scale factor provider 16, and may sense the current flowing through the first power source line ELVDDL in the second period to provide a second sensing current value to the scale factor provider 16. A memory may store a first block target current value corresponding to the first sensing current value and store a second block target current value corresponding to the second sensing current value.

A storing process of the block target current values may be performed once when the display device 10 is turn-on. In other embodiments, a time point at which this process is performed may be variously set and may be performed multiple times.

The scale factor provider 16 may be connected to the current sensor 15 and the timing controller 11. The scale factor provider 16 may compare the sensing current value provided by the current sensor 15 with a target current value to provide a scale factor. The target current value may be generated using the above-described block target current values and a frame load value.

In this case, the timing controller 11 may scale the gray values of the pixels PXij, PXi(j+1), and PX(i+1)j using the scale factor. The scale factor may be commonly applied to all the pixels of the pixel unit 14. For example, the timing controller 11 may scale a grayscale value of the pixel PXij and a grayscale value of the pixel PXi(j+1) using the scale factor. That is, the timing controller 11 may scale a grayscale value of the pixel Pxij and a grayscale value of the pixel PXi(j+1) based on grayscale values of the frame and the sensing current values.

In this case, the data driver 12 may apply data voltages corresponding to the scaled grayscale values to the data lines D1 to Dn. For example, the data driver 12 may apply the data voltage corresponding to the scaled grayscale value of the pixel PXij to the j-th data line Dj, and the data voltage corresponding to the scaled grayscale value of the pixel PXi(j+1) to the (j+1)th data line D(j+1).

Figure 2:
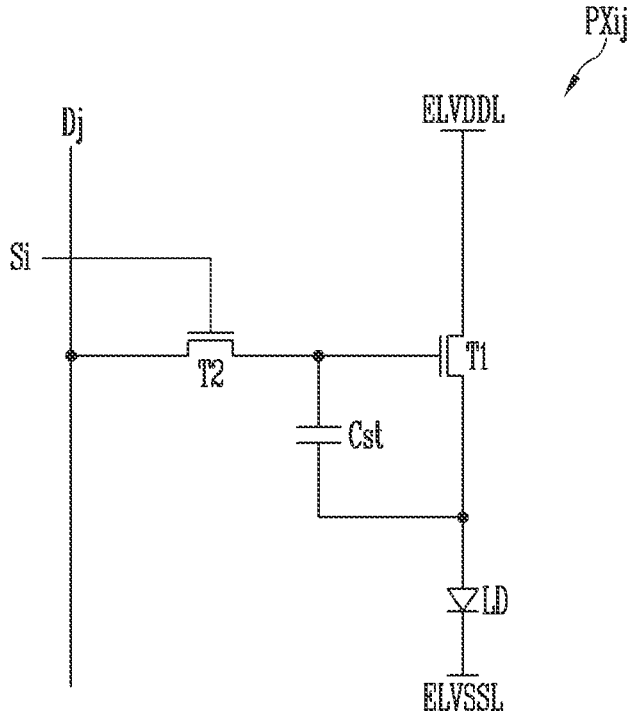
FIG. 2 is a circuit diagram illustrating a pixel according to an embodiment of the present inventive concept.

FIG. 2 is a circuit diagram illustrating a pixel according to an embodiment of the present inventive concept.

Referring to FIG. 2, the pixel PXij may include transistors T1 and T2, a storage capacitor Cst, and a light emitting diode LD.

Hereinafter, a circuit including N-type transistors will be described as an example. However, those skilled in the art will be able to design a circuit including P-type transistors. When using the P-type transistors, a polarity of voltage applied to a gate electrode may be different from that using the N-type transistors. Similarly, one of ordinary skill in the art would be able to design a circuit including a combination of a P-type transistor and an N-type transistor. The P-type transistor is a generic term for a transistor in which the amount of current to be conducted increases when a voltage difference between a gate electrode and a source electrode increases in a negative direction. The N-type transistor is a generic term for a transistor in which the amount of current to be conducted increases when a voltage difference between a gate electrode and a source electrode increases in a positive direction. The transistor may be configured in various forms such as a thin film transistor (TFT), a field effect transistor (FET), and a bipolar junction transistor (BJT).

The first transistor T1 may include a gate electrode connected to a first electrode of the storage capacitor Cst, a first electrode connected to the first power source line ELVDDL, and a second electrode connected to a second electrode of the storage capacitor Cst. The first transistor T1 may be referred to as a driving transistor.

The second transistor T2 may include a gate electrode connected to the i-th scan line Si, a first electrode connected to the j-th data line Dj, and a second electrode connected to the gate electrode of the first transistor T1. The second transistor T2 may be referred to as a scan transistor.

The light emitting diode LD may include an anode connected to the second electrode of the first transistor T1 and a cathode connected to the second power source line ELVSSL. The light emitting diode LD may be an organic light emitting diode, an inorganic light emitting diode, a quantum dot light emitting diode, or the like. In another embodiment, the anode of the light emitting diode LD may be connected to the first power source line ELVDDL, and the cathode may be connected to the first electrode of the first transistor T1.

A first power source voltage may be applied to the first power source line ELVDDL, and a second power source voltage may be applied to the second power source line ELVSSL. For example, the first power source voltage may be greater than the second power source voltage.

When a scan signal of a turn-on level (here, logic high level) is applied through the scan line Si, the second transistor T2 may be turned on. At this time, the data voltage applied to the data line Dj may be stored in the storage capacitor Cst.

A positive driving current corresponding to a voltage difference between the first electrode and the second electrode of the storage capacitor Cst may flow between the first electrode and the second electrode of the first transistor T1. Accordingly, the light emitting diode LD may emit light with luminance corresponding to the data voltage. The sensing current value provided by the current sensor 15 may be a sum of driving current values flowing through all the pixels of the pixel unit 14. Because the magnitude of the data voltages is adjusted by the scale factor, the driving current values of the pixels may be adjusted.

Next, when a scan signal of a turn-off level (here, logic low level) is applied through the scan line Si, the second transistor T2 may be turned off, and the data line Dj and the storage capacitor Cst may be electrically isolated. Therefore, even if the data voltage of the data line Dj is changed, the voltage stored in the first electrode of the storage capacitor Cst is not changed.

The pixel PXij of FIG. 2 is exemplarily illustrated, and embodiments of the present inventive concept may be applied to pixel circuits having different configuration. For example, pixels may further receive an emission control signal so that an emission period may be adjusted.

Figure 3:
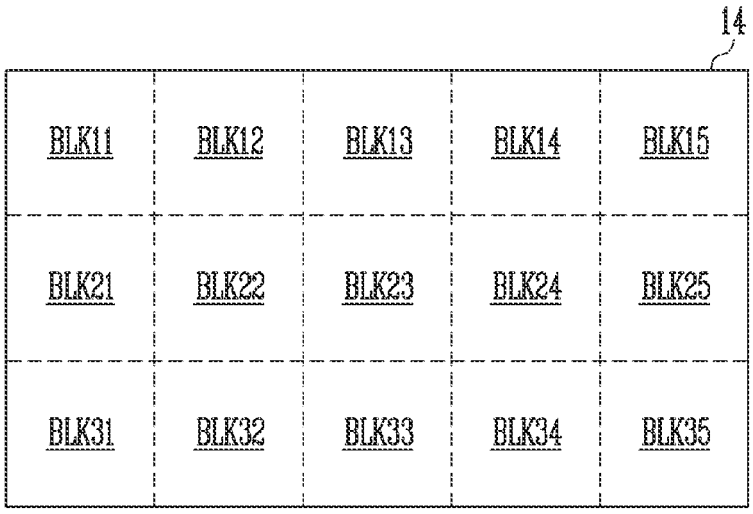
FIG. 3 is a diagram illustrating a pixel unit according to an embodiment of the present inventive concept.

FIG. 3 is a diagram illustrating a pixel unit according to an embodiment of the present inventive concept.

Referring to FIG. 3, the pixels of the pixel unit 14 may be divided into a plurality of blocks BLK11, BLK12, BLK13, BLK14, BLK15, BLK21, BLK22, BLK23, BLK24, BLK25, BLK31, BLK32, BLK33, BLK34, and BLK35. Each of the blocks BLK11 to BLK35 may include at least one pixel. The number of blocks BLK11 to BLK35 may be equal to or smaller than the number of pixels.

For example, when the pixel unit 14 has a resolution of Ultra High Definition (UHD), the pixel unit 14 may include 3840*2160 pixels. For example, there may be 3,840 pixels in one horizontal line. For example, 3840 pixels may be connected to each scan line. For example, 2160 pixels may exist in one vertical line. For example, 2160 pixels may be connected to one data line.

For example, when the pixel unit 14 is divided into 100 blocks, each of blocks may include the same number of pixels. For example, each of blocks may include 384*216 pixels.

Figure 4:
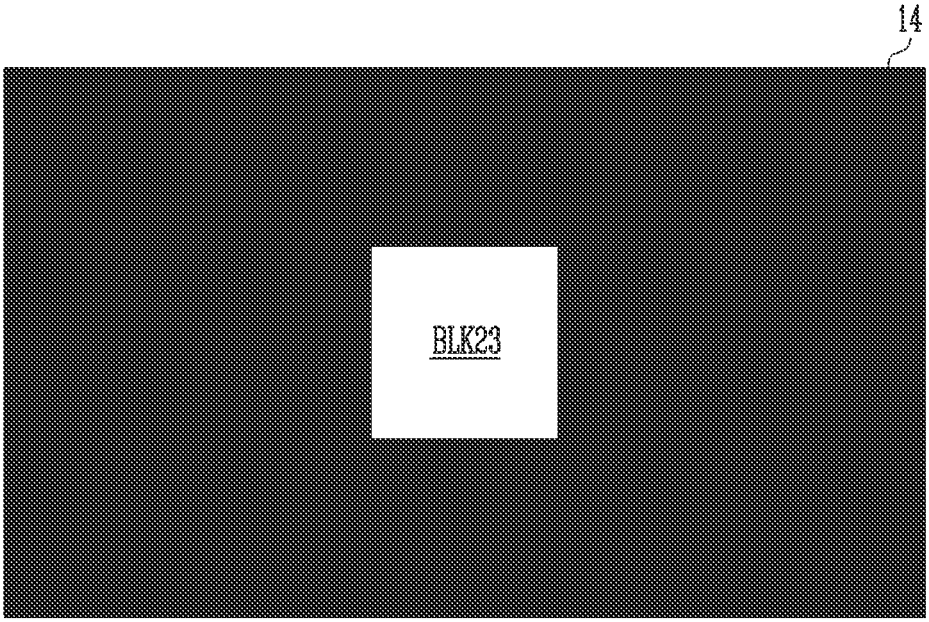
FIG. 4 is a diagram for explaining a problem occurring when a target current value is set based on a specific block of the pixel unit.
Figure 5:
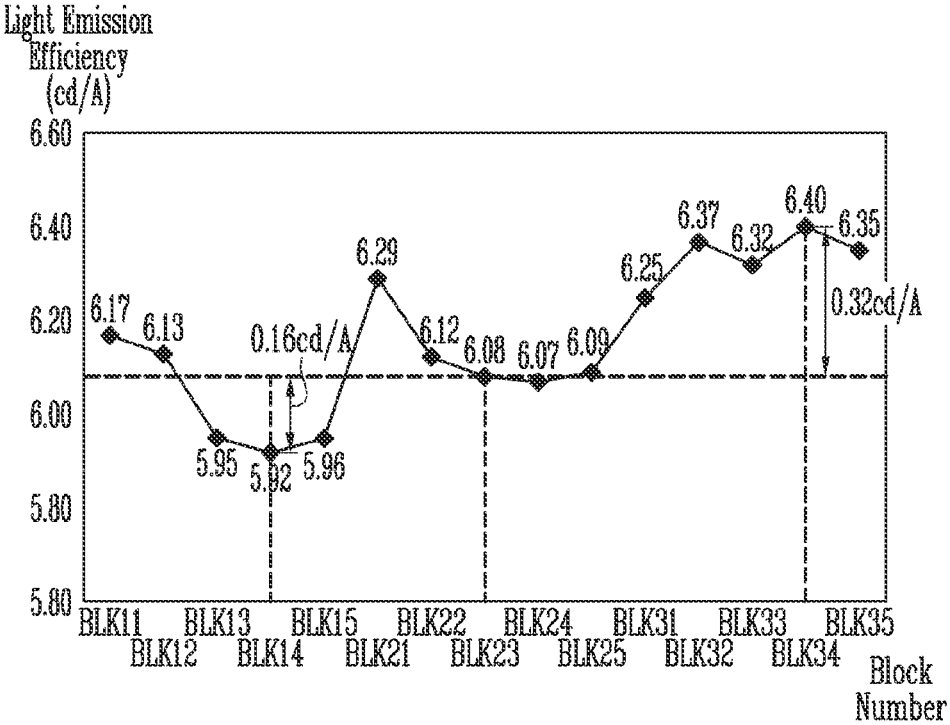
FIGS. 5, 6 and 7 are graphs for explaining a problem occurring when a target current value is set based on a specific block of the pixel unit.
Figure 6:
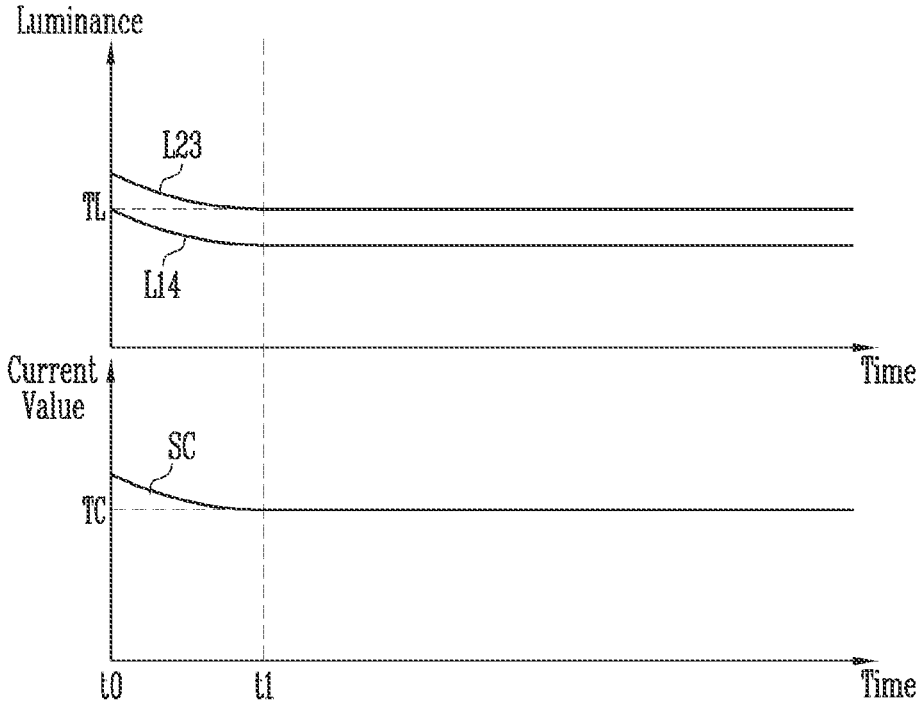
Figure 7:
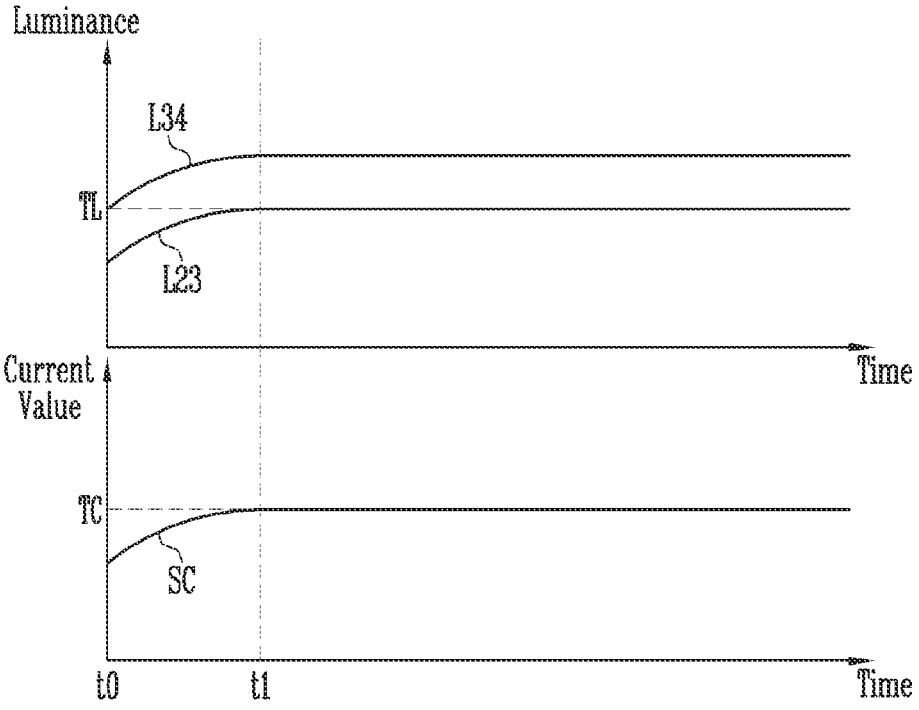

FIG. 4 is a diagram for explaining a problem occurring when a target current value is set based on a specific block of the pixel unit. FIGS. 5 to 7 are graphs for explaining a problem occurring when a target current value is set based on a specific block of the pixel unit.

When the display device 10 is turned on, the pixels included in a specific block BLK23 of the pixel unit 14 may emit light with the highest grayscale (for example, white grayscale), and the remaining blocks may not emit light (for example, black grayscale). The block BLK23 may be a block disposed at the center of the pixel unit 14.

In this case, the current sensor 15 may sense the current flowing through the first power source line ELVDDL to provide a sensing current value SC. Assuming that there are 100 blocks as in the above example, the sensing current value SC may be a current value flows through pixels in the block BLK23 which corresponds to 1% of the pixel in the pixel unit 14 of a full-white image frame. The full-white image frame may refer to an image frame in which all pixels of the pixel unit 14 emit light with the highest grayscales (white grayscales). In the embodiment of FIGS. 4 to 7, the unit target current value may be generated once when the display device 10 is turned on and the unit target current value may be stored in the memory. The stored unit target current value may be used during a display period of image frames of the display device 10. In the embodiment of FIGS. 4 to 7, the unit target current value which is stored in the memory may not be changed over time during the display period. That is, in the embodiment of FIGS. 4 to 7, the unit target current value may be a single value.

For example, during the display period, the scale factor provider 16 may obtain a target current value TC for the corresponding image frame by multiplying the unit target current value by a frame load value FL. The frame load value may be decided corresponding to grayscale values of the frame. For example, the greater the sum of the grayscale values of a frame, the larger the frame load value FL of the frame.

For example, the frame load value FL may be 100 in a full-white image frame and the frame load value FL may be 0 in a full-black image frame. The full-black image frame may mean an image frame in which all pixels of the pixel unit 14 are set to the lowest grayscales (black grayscales) and thus do not emit light. That is, the frame load value FL may have a value between 0 and 100.

The scale factor provider 16 may compare the sensing current value SC received from the current sensor 15 with the target current value TC to provide a scale factor. The scale factor provider 16 may provide the scale factor such that the grayscale values of the pixels are largely scaled when the sensing current value SC is smaller than the target current value TC. The scale factor provider 16 may provide the scale factor such that the grayscale values of pixels are scaled down when the sensing current value SC is greater than the target current value TC. The above driving process may be referred to as global current management (GCM).

Global current management based on the specific block BLK23 may be appropriate when all the blocks BLK11 to BLK35 of the pixel unit 14 have the same light emission efficiency. However, as described above, the light emission efficiencies of the blocks BLK11 to BLK35 may be different due to process variations during the display device 10 is manufactured.

Referring to FIG. 5, the light emission efficiencies of the blocks BLK11 to BLK35 are exemplarily illustrated. The light emission efficiencies shown in FIG. 5 mean luminous intensity (unit: candela) per current (unit: ampere) required when each of the blocks BLK11 to BLK35 emits light at 500 nits. Because the above-described scale factor is decided based on the light emission efficiency of the specific block BLK23, it is only suitable when the light emission efficiencies of all the blocks BLK11 to BLK35 of the pixel unit 14 are equal to each other at 6.08 cd/A which is represented as a dotted line extending horizontally. However, some blocks may have a lower light emission efficiency than the block BLK23. For example, the block BLK14 may have a light emission efficiency of 5.92 cd/A. In addition, some blocks may have a higher light emission efficiency than the block BLK23. For example, the block BLK34 may have a light emission efficiency of 6.40 cd/A.

Referring to FIG. 6, it is assumed that the sensing current value SC is greater than the target current value TC at a time point t0. In this case, the scale factor will be provided to reduce the sensing current value SC. Because the target current value TC is set based on the block BLK23, the sensing current value SC may converge to the target current value TC at a time point t1, and thus, at the time point t1, a luminance L23 of the block BLK23 may converge to a target luminance TL.

Because the block BLK14 has the lower light emission efficiency than the block BLK23, a luminance L14 of the block BLK14 may be close to the target luminance TL at the time point t0. However, due to the scale factor commonly applied, the luminance L14 becomes smaller than the target luminance TL at the time point t1. In addition, when the frame load value remains the same after the time point t1 (for example, a still image), the insufficient luminance L14 of the block BLK14 is maintained so that luminance non-uniformity of the pixel unit 14 may be visually recognized by the user.

Referring to FIG. 7, when the sensing current value SC is smaller than the target current value TC at the time point t0. In this case, the scale factor will be provided to increase the sensing current value SC. Because the target current value TC is set based on the specific block BLK23, the sensing current value SC may converge to the target current value TC at the time point t1, and thus, at the time point t1, the luminance L23 of the block BLK23 may also converge to the target luminance TL.

Because the block BLK34 has a higher light emission efficiency than the block BLK23, a luminance L34 of the block BLK34 may be close to the target luminance TL at the time point t0. However, due to the scale factor commonly applied, the luminance L34 becomes larger than the target luminance TL at the time point t1. In addition, when the frame load value remains the same after the time point t1 (for example, a still image), the exceeded luminance L14 of the block BLK34 is maintained so that the luminance non-uniformity of the pixel unit 14 may be visually recognized by the user.

Figure 8:
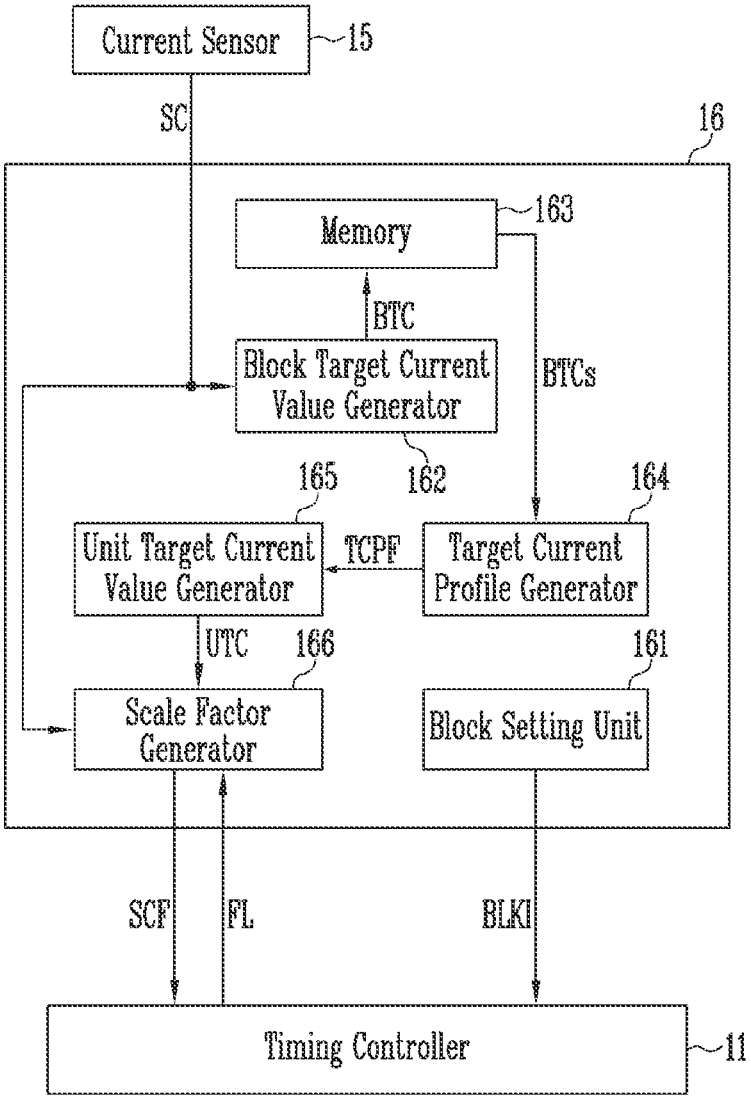
FIG. 8 is a block diagram illustrating a scale factor provider according to an embodiment of the present inventive concept.
Figure 9:
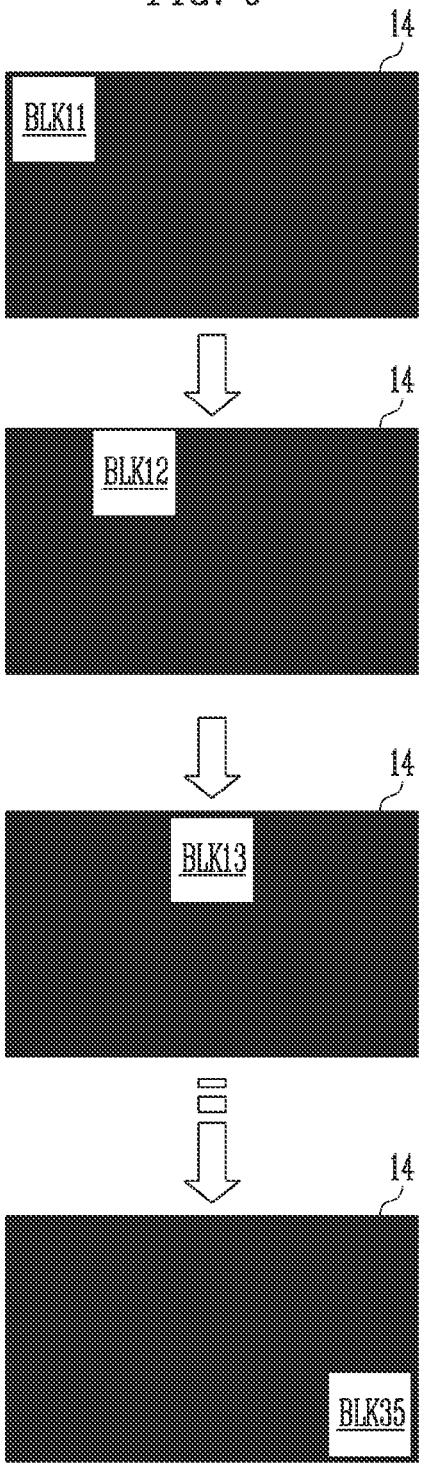
FIG. 9 is a diagram illustrating a block target current value generator and a memory according to an embodiment of the present inventive concept.

FIG. 8 is a block diagram illustrating a scale factor provider according to an embodiment of the present inventive concept. FIG. 9 is a diagram illustrating a block target current value generator and a memory according to an embodiment of the present inventive concept. FIGS. 10 to 13 are graphs for explaining a target current profile generator according to an embodiment of the present inventive concept. FIGS. 14 to 17 are graphs for explaining a unit target current value generator according to an embodiment of the present inventive concept.

Referring to FIG. 8, the scale factor provider 16 according to an embodiment of the present inventive concept may include a block setting unit 161, a block target current value generator 162, a memory 163, a target current profile generator 164, a unit target current value generator 165, and a scale factor generator 166.

The scale factor provider 16 may be an integrated chip (IC) which is separate from the timing controller 11. Meanwhile, all or part of the scale factor provider 16 may be integrated into the timing controller 11. On the other hand, all or part of the scale factor provider 16 may be implemented in software in the timing controller 11.

The block setting unit 161 may be connected to the timing controller 11 and set the blocks BLK11 to BLK35 so that each of the blocks BLK11 to BLK35 includes at least one pixel. The blocks BLK11 to BLK35 set as an example with reference to FIG. 3 and related descriptions. According to an embodiment, the block setting unit 161 may set blocks to include different numbers of pixels. According to an embodiment, the block setting unit 161 may set blocks such that adjacent blocks share at least one pixel. In addition, the block setting unit 161 may set blocks in various ways.

The block target current value generator 162 may be connected to the current sensor 15, the scale factor generator 166 and the memory 163. The block target current value generator 162 may provide a representative value of the sensing current value SC which is provided from the current sensor 15 as a block target current value BTC to the memory 163. For example, the representative value may be an average value of sensing current values SC which are provided from the current sensor 15 during a sensing period for each of the blocks BLK11 to BLK35. As another example, the representative value may be a weighted average value of sensing current values SC. If the current sensor 15 provides the sensing current value SC only once in the sensing period of the block, the block target current value BTC of the block may be the same as the sensing current value SC.

Referring to FIG. 9, in the first period, the block BLK11 may emit light at the maximum grayscale and the remaining blocks may not emit light. In this case, the current sensor 15 may sense the current flowing through the first power source line ELVDDL and provide the current flowing through the first power source line ELVD as a first sensing current value to the block target current value generator 162. The block target current value generator 162 may provide the representative value of the first sensing current value provided a plurality of times during the first period as a first block target current value. The memory 163 may store the first block target current value.

In a second period following the first period, the block BLK12 may emit light at the maximum grayscale and the remaining blocks may not emit light. In this case, the current sensor 15 may sense the current flowing through the first power source line ELVDDL and provide the current flowing through the first power source line ELVD as a second sensing current value to the block target current value generator 162. The block target current value generator 162 may provide the representative value of the second sensing current value provided a plurality of times during the second period as a second block target current value. The memory 163 may store the second block target current value.

Similarly, the same procedure as the first period and the second procedure is repeated to store block target current values BTCs of the blocks BLK11 to BLK35 in the memory 163. The light emission order of the blocks BLK11 to BLK35 may be arbitrarily determined.

The storage process of the block target current values BTCs may be performed once when the display device 10 is turned on. In other embodiments, the storage process may be performed at least two times and number of repetitions may be decided as needed.

The target current profile generator 164 may be connect to the memory 163 and the unit target current value generator 165, and may generate a target current profile TCPF corresponding to a histogram which includes the block target current values BTCs.

Figure 10:
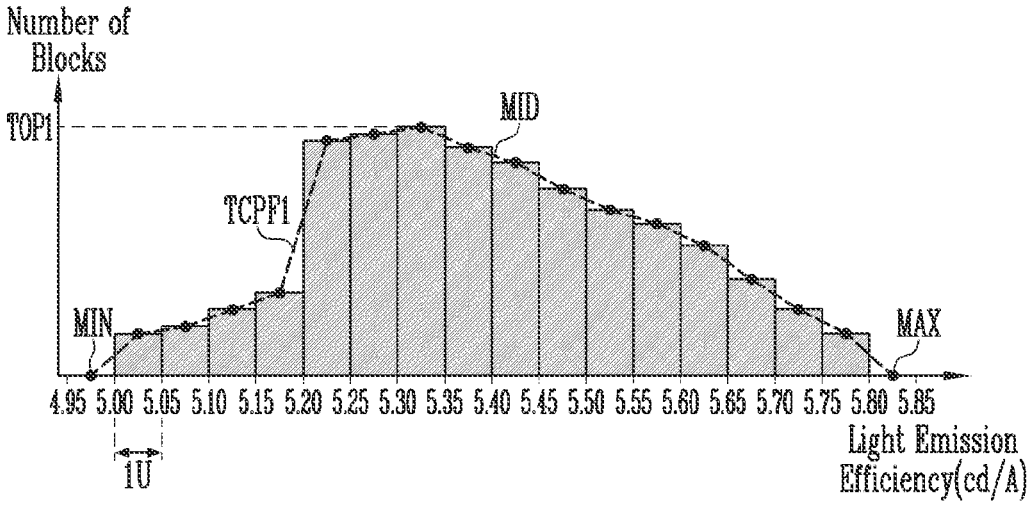
FIGS. 10, 11, 12 and 13 are graphs for explaining a target current profile generator according to an embodiment of the present inventive concept.

Referring to FIG. 10, an exemplary target current profile TCPF1 is shown. In the graph, a horizontal axis represents the light emission efficiency (cd/A) and a vertical axis represents the number of blocks. Each interval 1U of the light emission efficiency may be arbitrarily determined within a range in which the histogram has a significant shape.

Because the block target current values BTCs are sensing current values SC measured at the same luminance (for example, maximum grayscale), the block target current values BTCs may inversely proportional to the light emission efficiency. That is, the larger the block target current values BTCs is, the smaller the light emission efficiency may be. Weights applied when converting the block target current values BTCs into the light emission efficiency may be set in various method according to embodiments. In addition, the light emission efficiency may be calculated using an appropriate conversion equation. Alternatively, the horizontal axis of the histogram may be the block target current values BTCs.

Figure 11:
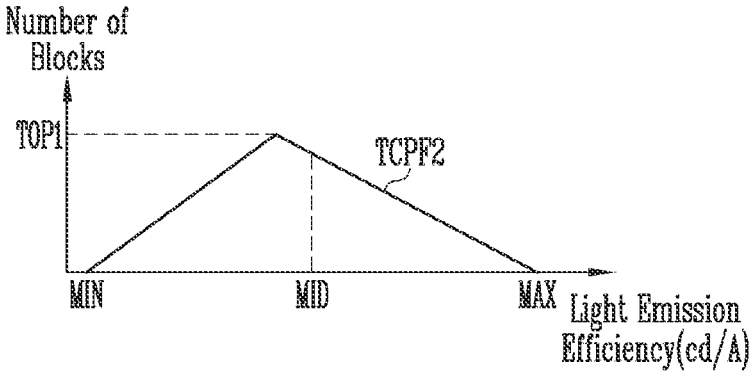

Referring to FIG. 11, a target current profile TCPF2 is a simplified graph of the target current profile TCPF1. The target current profile TCPF2 is a graph which connects a minimum value MIN of the light emission efficiency, a maximum value MAX of the light emission efficiency, and a maximum value TOP1 of the target current profile TCPF1.

When the target current profile TCPF1 of FIG. 10 is used, the target current value TC may change abruptly, and thus, luminance change may be visually recognized by the user (for example, as a flicker). Therefore, the target current profile TCPF2 which reduces gradient by using some parameters of the target current profile TCPF1 may be used.

Figure 12:
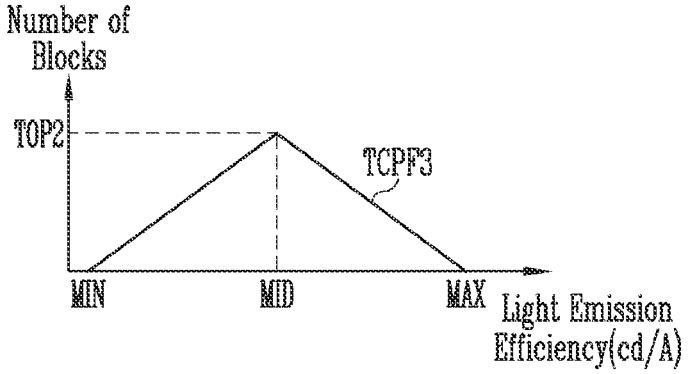

Referring to FIG. 12, a target current profile TCPF3 simplified into a triangular shape using the minimum value MIN of the light emission efficiency of the target current profile TCPF1, the maximum value MAX of the light emission efficiency, and an intermediate value MID of the light emission efficiency is shown as an example. In this case, a maximum value TOP2 of the number of blocks may be the same as or different from the maximum value TOP1.

Figure 13:
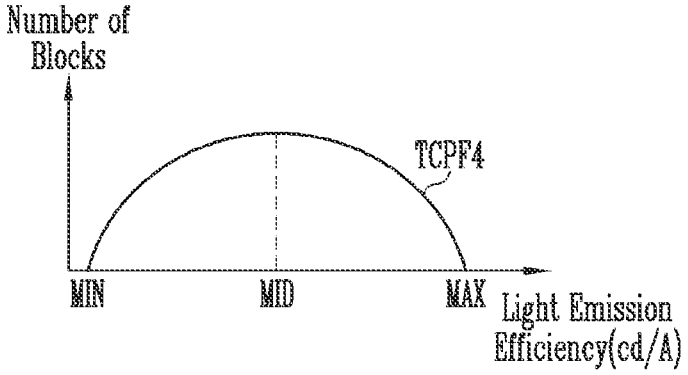

In addition, referring to FIG. 13, a target current profile TCPF4 simplified into a semi-circular shape using the minimum value MIN of the light emission efficiency of the target current profile TCPF1, the maximum value MAX of the light emission efficiency, and the intermediate value MID of the light emission efficiency is shown.

As such, the target current profile generator 164 may generate the target current profile TCPF in various ways.

The above-described operation of the target current profile generator 164 may be performed once when the display device 10 is turned on or arbitrarily performed during the display period of the display device 10.

The unit target current value generator 165 may be connected to the target current profile generator 164 and the scale factor generator 166, determine target current waveforms WV1, WV2, and WV3 based on the target current profile TCPF, and provide a unit target current value UTC that is an instantaneous value of the target current waveforms WV1, WV2, and WV3 to the scale factor generator 166.

Figure 14:
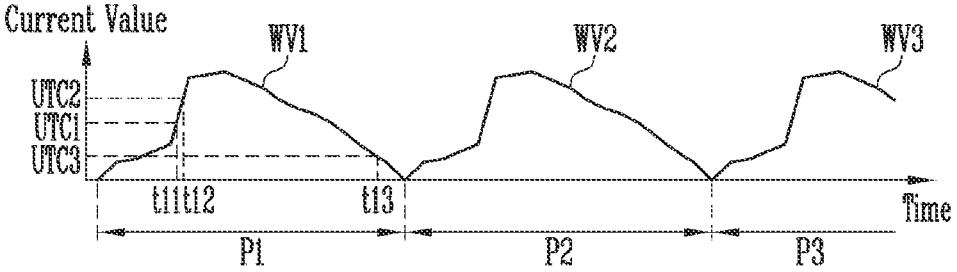
FIGS. 14, 15, 16 and 17 are graphs for explaining a unit target current value generator according to an embodiment of the present inventive concept.

Referring to FIG. 14, as an example, the target current profile TCPF1 of FIG. 10 is determined as the target current waveforms WV1, WV2, and WV3, and unit target current values UCT1, UTC2, and UTC3 are sequentially provided at respective time points t11, t12, and t13.

Each of the target current waveforms WV1, WV2, and WV3 may be obtained by changing a unit of the horizontal axis of the target current profile TCPF1 with time and a unit of the vertical axis with a current value. Weight according to the unit change may be set in various ways. The target current waveforms WV1, WV2, and WV3 may be continuous with each other.

The scale factor generator 166 may be connected to the current sensor 15, the block target current value generator 162, the unit target current value generator 165 and the timing controller 11, generate the target current value TC using a frame load value FL provided by the timing controller 11 and the unit target current value UTC provided by the unit target current value generator 165 at a time point corresponding to the unit target current value UTC, and generate a scale factor SCF according to a difference between the sensing current value SC provided by the current sensor 15 and the target current value TC generated in the scale factor generator 166.

For example, the scale factor generator 166 may generate the target current value TC by multiplying the unit target current value UTC by the frame load value FL. At this time, any weight may be used. An exemplary description of the unit target current value UTC and the frame load value FL is provided with reference to the description of FIG. 4. However, in the present embodiment, the unit target current value UTC may be a value that varies with time rather than a fixed value (see FIG. 14). The timing controller 11 may provide the frame load value FL generated by analyzing grayscale values of an image frame.

The scale factor generator 166 may generate the scale factor SCF such that the grayscale values of the pixels become smaller when the sensing current value SC is greater than the target current value TC. In addition, if the sensing current value SC is smaller than the target current value TC, the scale factor generator 166 may generate the scale factor SCF such that the grayscale values of the pixels become larger.

The timing controller 11 may use the scale factor SCF as shown in Equation 1 below.

$$OUTG = ING * SCF / GR \quad \text{Equation 1}$$

Here, OUTG may be an output grayscale value, ING may be an input grayscale value, SCF may be the scale factor SCF, and GR may be a grayscale resolution.

The input grayscale value may be a grayscale value input from an external processor to the timing controller 11, and the output grayscale value may be a grayscale value provided by the timing controller 11 to the data driver 12.

For example, when each grayscale value is represented by 10 bits, the grayscale resolution may be 1024. At this time, each of the input and output grayscale values ING and OUTG may have a value ranging from 0 to 1023. When each grayscale value is represented by 8 bits, the grayscale resolution may be 256. At this time, the input and output grayscale values ING and OUTG may have a value ranging from 0 to 255. The output grayscale value OUTG falling out of the range may be set to the maximum value of the range.

The magnitude of the scale factor SCF may be proportional to a difference between the sensing current value SC and the target current value TC. For example, if the sensing current value SC is greater than the target current value TC, the scale factor generator 166 may generate the scale factor SCF smaller than the grayscale resolution. In addition, if the sensing current value SC is smaller than the target current value TC, the scale factor generator 166 may generate the scale factor SCF larger than the grayscale resolution.

Figure 15:
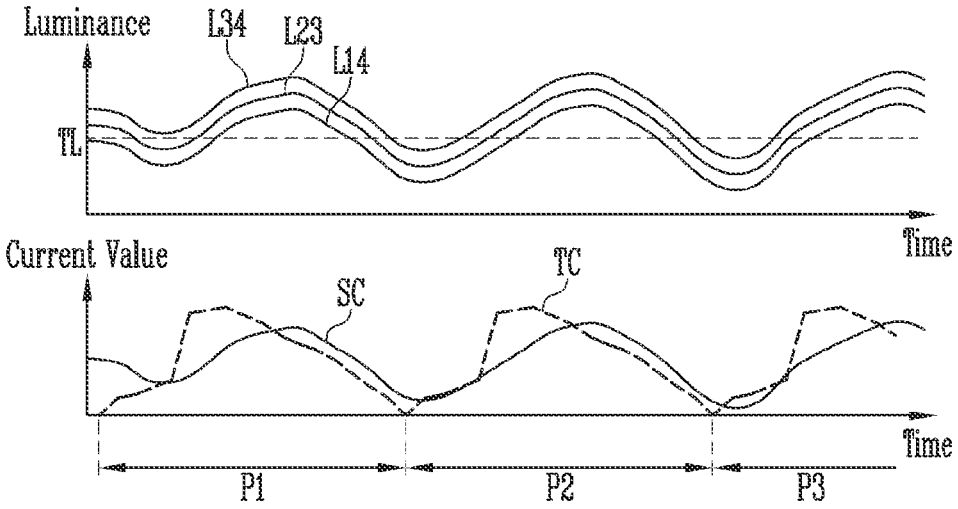

Referring to FIG. 15, the target current value TC generated based on the target current waveforms WV1, WV2, and WV3 of FIG. 14 is shown. For convenience of explanation, the frame load value FL is assumed to be constant (for example, a still image). Accordingly, a waveform of the target current value TC of FIG. 15 may be similar to the target current waveforms WV1, WV2, and WV3 of FIG. 14.

Because the target current value TC changes with time, the scale factor SCF also changes with time. A waveform of the sensing current value SC has a shape such that the waveform follows the waveform of the target current value TC. Therefore, the waveform of the sensing current value SC may be similar to the waveform of the target current value TC. In this case, an amplitude of the waveform of the sensing current value SC may be smaller than that of the waveform of the target current value TC. In addition, a slope of the waveform of the sensing current value SC may be gentler than that of the waveform of the target current value TC. This means that even with the non-simplified target current profile TCPF1 of FIG. 10, a sudden luminance change can be alleviated to some extent.

Because it is assumed that the image is a still image, the target luminance TL may be constant over time. The luminance L23 of the block BLK23, the luminance L14 of the block BLK14, and the luminance L34 of the block BLK34 all change smoothly around the target luminance TL. Therefore, unlike FIGS. 6 and 7, because each of the blocks BLK11 to BLK35 emits light with a luminance similar to that of the target luminance TL, in spite of the process variations of the pixels of the pixel unit 14, a luminance non-uniformity phenomenon can be alleviated.

According to the embodiment, even though the grayscale values remain the same in successive frames (that is, in the case of a still image), the sensing current value SC and the data voltages of the pixels included in the blocks BLK11 to BLK35 may change. The change in the data voltages of the pixels can be seen through waveforms of the luminances L14, L23, and L34 of FIG. 15. The waveforms of the luminances L14, L23, and L34 and the waveforms of the data voltages of the pixels may have substantially the same pattern.

The sensing current value SC and the data voltages may change with substantially the same pattern. For example, the sensing current value SC and the data voltages may change with the same cycle. For example, the sensing current value SC and the data voltages may change simultaneously with the same increase and decrease direction.

Figure 16:
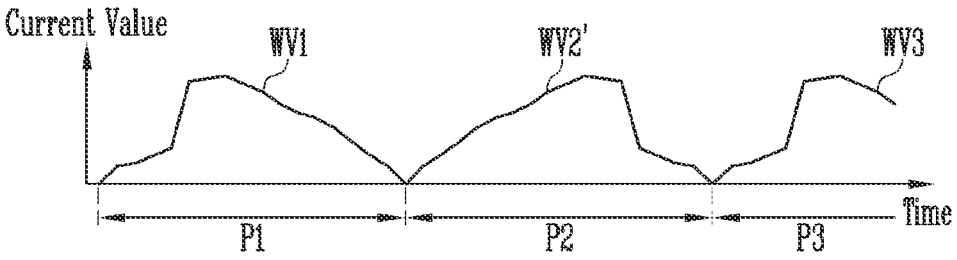
Figure 17:
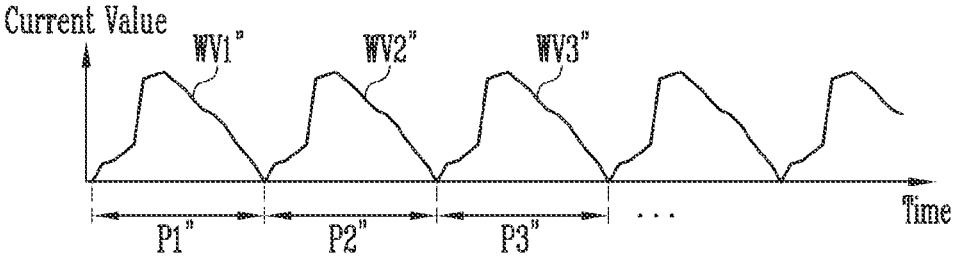

The unit target current value generator 165 may set target current waveforms WV1, WV2', and WV3 so that at least two of the target current waveforms WV1, WV2', and WV3 are different from each other based on the target current profile TCPF. Referring to FIG. 16, the target current waveforms WV1, WV2', and WV3 have been set such that the non-inverted target current waveforms WV1 and WV3 and the inverted target current waveform WV2' are repeated over time. According to this embodiment, undesirable display patterns due to regularity over time can be prevented from being recognized by the user.

The unit target current value generator 165 may differently set frequencies of target current waveforms WV1", WV2", and WV3". For example, the frequencies of the target current waveforms WV1", WV2", and WV3" of FIG. 17 may be higher than those of the target current waveforms WV1, WV2, and WV3 of FIG. 14. That is, periods P1", P2", and P3" of FIG. 17 may be shorter than periods P1, P2, and P3 of FIG. 14. Alternatively, the frequency of the target current waveforms may be set lower than that of the target current waveforms WV1, WV2, and WV3 of FIG. 14. The frequency may be appropriately set in consideration of a temperature change of the display device 10 and the degree of visibility of flicker.

The above-described operations of the unit target current value generator 165 and the scale factor generator 166 may be continuously performed during the display period of the image frames of the display device 10.

The display device and the driving method according to the present inventive concept can supply an appropriate current to the pixels having different light emission efficiencies in response to the load value of the image frame.

As described above, the optimal embodiments of the inventive concept have been disclosed through the detailed description and the drawings. It is to be understood that the terminology used herein is for the purpose of describing the inventive concept only and is not used to limit the scope of the inventive concept described in the claims. Therefore, those skilled in the art will appreciate that various modifications and equivalent embodiments are possible without departing from the scope of the inventive concept. Accordingly, the true scope of the inventive concept should be determined by the technical idea of the appended claims.

What is claimed is:

1. A display device comprising:

a first block including a plurality of first pixels and having a first light emission efficiency;

a second block including a plurality of second pixels and having a second light emission efficiency higher than the first light emission efficiency; and a third block including a plurality of third pixels and having a third light emission efficiency higher than the second light emission efficiency, wherein, when the first block, the second block, and the third block display a still image, luminance waveforms of the first block, the second block, and the third block have a same shape but with different amplitudes.

2. The display device of claim 1, wherein the luminance waveform of the first block has a first amplitude at a time point, wherein the luminance waveform of the second block has a second amplitude larger than the first amplitude at the time point, and wherein the luminance waveform of the third block has a third amplitude larger than the second amplitude at the time point.

3. The display device of claim 1, wherein a first pixel, among the plurality of first pixels, connected to a first data line, a first scan line, and a first power source line, emitting light in a first period, and not emitting light in a second period following the first period, wherein a second pixel, among the plurality of second pixels, connected to a second data line, the first scan line, and the first power source line, not emitting light in the first period, and emitting light in the second period, and wherein the display device further comprises:

a current sensor sensing a current flowing through the first power source line in the first period to generate a first sensing current value, and sensing the current flowing through the first power source line in the second period to generate a second sensing current value; and a memory storing a first block target current value corresponding to the first sensing current value and a second block target current value corresponding to the second sensing current value.

4. The display device of claim 3, further comprising:

a block target current value generator generating a representative value of a plurality of the first sensing current values as the first block target current value, and generating a representative value of a plurality of the second sensing current values as the second block target current value.

5. The display device of claim 3, further comprising:

a target current profile generator generating a target current profile corresponding to a histogram including the first block target current value and the second block target current value.

6. The display device of claim 5, further comprising:

a unit target current value generator determining target current waveforms based on the target current profile, and generating a unit target current value that is an instantaneous value of the target current waveforms.

7. The display device of claim 6, further comprising:

a scale factor generator generating a target current value using the unit target current value and a frame load value corresponding to the unit target current value, and generating a scale factor according to a difference between a sensing current value provided by the current sensor and the target current value.

8. The display device of claim 7, further comprising:

a timing controller scaling a first grayscale value for the first pixel and a second grayscale value for the second pixel using the scale factor.

9. The display device of claim 8, further comprising:

a data driver applying a first data voltage corresponding to a scaled first grayscale value to the first data line, and applying a second data voltage corresponding to a scaled second grayscale value to the second data line.

10. The display device of claim 1, wherein a first pixel, among the plurality of first pixels, connected to a first data line, a first scan line, and a first power source line, wherein a second pixel, among the plurality of second pixels, connected to a second data line, the first scan line, and the first power source line, wherein the display device further comprises:

a current sensor sensing a current flowing through the first power source line to generate a sensing current value;

a timing controller scaling a first grayscale value for the first pixel and a second grayscale value for the second pixel based on grayscale values of a frame and the sensing current value; and a data driver applying a first data voltage corresponding to a scaled first grayscale value to the first data line, and applying a second data voltage corresponding to a scaled second grayscale value to the second data line, and wherein the sensing current value, the first data voltage, and the second data voltage are changed although the grayscale values remain the same in successive frames.

11. The display device of claim 10, wherein the first pixel emits light in a first period, and emits no light in a second period following the first period, wherein the second pixel emits no light in the first period, and emits light in the second period, and wherein the current sensor senses a current flowing through the first power source line in the first period to generate a first sensing current value, and senses the current flowing through the first power source line in the second period to generate a second sensing current value.

12. The display device of claim 11, further comprising:

a block target current value generator generating a representative value of a plurality of the first sensing current values as a first block target current value, and generating a representative value of a plurality of the second sensing current values as a second block target current value.

13. The display device of claim 12, further comprising:

a memory storing the first block target current value and the second block target current value.

14. The display device of claim 13, further comprising:

a target current profile generator generating a target current profile corresponding to a histogram including the first block target current value and the second block target current value.

15. The display device of claim 14, further comprising:

a unit target current value generator determining target current waveforms based on the target current profile provided by the target current profile generator, and generating a unit target current value that is an instantaneous value of the target current waveforms.

16. The display device of claim 15, further comprising:

a scale factor generator generating a target current value using the unit target current value and a frame load value corresponding to the unit target current value, and generating a scale factor according to a difference between a sensing current value provided by the current sensor and the target current value, wherein the frame load value corresponds to the grayscale values of the frame.

17. The display device of claim 1, wherein a plurality of blocks including the first block, the second block, and the third block are connected to a first power source line, and wherein the display device further comprises:

a current sensor connected to the first power source line, the current sensor sensing a current flowing through the first power source line during a first period when the plurality of first pixels in the first block emit light and the plurality of second pixels in the second block do not emit light, and a current flowing through the first power source line during a second period when the plurality of second pixels in the second block emit light and the plurality of first pixels in the first block do not emit light; and a scale factor provider connected to the current sensor and a timing controller, the scale factor including a memory storing a first block target current value which correspond to the current flowing through the first power source line during the first period and a second block target current value which correspond to the current flowing through the first power source line during the second period.

18. The display device of claim 17, wherein the current sensor sensing the current flowing through the first power source line at least two times during the first period and the second period, respectively to generate a plurality of first sensing current values and a plurality of second sensing current values, and wherein the scale factor provider further comprising:

a block target current value generator connected to the current sensor and generating a representative value of the plurality of the first sensing current values as the first block target current value, and generating a representative value of the plurality of the second sensing current values as the second block target current value.

19. The display device of claim 18, the scale factor provider further comprising:

a target current profile generator connected to the memory and generating a target current profile corresponding to a histogram including the first block target current value and the second block target current value.

20. The display device of claim 19, the scale factor provider further comprising:

a unit target current value generator connected to the target current profile generator, determining target current waveforms based on the target current profile, and generating a unit target current value that is an instantaneous value of the target current waveforms.

* * * * *